United States Patent [19]

Licciardi et al.

[11] Patent Number: 4,886,267

[45] Date of Patent: Dec. 12, 1989

[54] BASEBALL PRACTICE APPARATUS

[76] Inventors: Terrence P. Licciardi, 73 Cox La.; James P. Licciardi, 16 Madison St., both of Methuen, Mass. 01844

[21] Appl. No.: 226,273

[22] Filed: Jul. 29, 1988

Related U.S. Application Data

[63] Continuation of Ser. No. 19,373, Feb. 26, 1987, abandoned.

[51] Int. Cl.[4] ..... A63B 69/40

[52] U.S. Cl. ..... 273/26 R

[58] Field of Search ..... 273/26 R, 183 A, 186 R, 273/186 C, 191 R, 33, 29 A

[56] References Cited

U.S. PATENT DOCUMENTS

| | | | |
|---|---|---|---|
| 3,139,282 | 6/1964 | Lande | 273/26 R |
| 4,367,879 | 6/1983 | Messer | 273/33 |
| 4,456,250 | 6/1984 | Perrone, Jr. | 273/26 R |
| 4,575,080 | 3/1986 | Miles | 273/29 A |
| 4,664,374 | 5/1987 | Groves | 273/26 R |

*Primary Examiner*—T. Brown

*Attorney, Agent, or Firm*—Edward A. Gordon

[57] ABSTRACT

A baseball practice apparatus including a batting tee and a swing guide that serves as a positive indication of the outer radius of a batter's swing whereby a batter will know if the rear elbow is dropped or if the wrists are prematurely broken in the swing. Each of the batting tee and the swing guide members are adjustable in height whereby differences in stances and batters' heights can be compensated for with the equipment.

12 Claims, 2 Drawing Sheets

BASEBALL PRACTICE APPARATUS

REFERENCE TO RELATED APPLICATION

This application is a continuation of Ser. No. 019,373 filed Feb. 26, 1987, now abandoned.

FIELD OF THE INVENTION

The present invention relates to improvements in batting practice apparatus, and more particularly, to an apparatus that is useful, for example, in practicing and perfecting batting swings of baseball players, and in improving the power of their swings.

BACKGROUND OF THE INVENTION

We believe that one of the more important aspects of batting is the batter's stance. While there may be only one way to hold a bat, there are many ways to hit a ball. Many elements go into a good batting stance and the apparatus of the present invention provides a device for perfecting the batter's stance and improving power of the batter's swing. In the development of a good swing, we believe that a hitter who drops the back elbow in the act of swinging will be "hacking up" on the ball. The proper stance for a batter, as the pitch is thrown and the thrown ball is awaited, is to have the wrists about even with the rear foot, and held at about chest height. If the rear forearm is on a plane at a right angle to the body, then an ideal stance is provided. In this way, the arms are being used as the pitch approaches. The stance, however, will be spoiled if, in the first stage of swinging the bat, that is the act of swinging the torso, the rear elbow is allowed to drop and if the bat is extended because the wrists are prematurely twisted. Such dropping of the rear elbow while swinging cannot be accomplished without artificially twisting the wrists, which in turn means that the power of the wrist snap, a requirement of good hitting, is lost to the batter. Therefore, as the player commences the swing, there should be no sudden drop of the rear elbow or extension of the bat. Rather, the elbow should travel, as much as possible, along a horizontal plane, at least until the swinging bat is parallel with the ball being thrown. Moreover, at the same time as the torso is being twisted, the bat must not "swing out", that is the bat must travel in a first radius until a point where the bat is about parallel to the path of the ball being thrown. As the bat passes over the parallel point in the batter's swing, the batter's arms are extended in a V-shape, which may be called the power portion of the swing. In this second portion of the swing, the winging bat describes a second radius, and it is during this second portion of the swing that the bat makes contact with the pitched ball.

In addition to the foregoing requirements, the front elbow also must be considered with respect to level swinging. If the front elbow is held too low, it causes the player to "hit down" on the ball. When the back elbow is held correctly, and the grip on the bat is right, the front elbow will almost automatically do what it is supposed to do for the batter. When the batter swings correctly without dipping the back elbow, and the wrist is snapped correctly, and if the player has a good line of sight on the ball being pitched, a ball can be well hit. The batter will twist the torso up to a predetermined point, without the elbows dipping and without extending the bat, the wrists will then be snapped to assume the V-shaped position, and the ball will be hit correctly.

DESCRIPTION OF THE PRIOR ART

Most commonly, verbal instructions have been given by coaches to batters to improve their batting style. Depending upon the batter, such instructions may have significant benefit. But with many batters, devices to aid them to improve their batting style can have significant advantages. In the U.S. Pat. to Trippet, No. 2,985,452, a device is shown which includes an upper supporting member together with elongated vertically spaced and generally parallelly disposed members which extend along a generally horizontal arc to define a guide path for a bat as it is swung. The device can provide improvements in defining a guide path for the batter in simulating striking a baseball and training the batter in executing a proper swing of the bat, but it does little to improve the back swing, that is the portion of the swing before the bat reaches a position parallel with the oncoming ball and before the wrists are to be snapped. As stated above, the back swing should be substantially horizontal.

The U.S. Pat. to Cardieri, No. 4,445,685 discloses a batting tee that is formed of an elongated, hollow, holder with a substantially flexible ball support member which is housed in the hollow holder. The ball support includes a mechanism to lock the height of the tee relative to the ground, whereby the position of the ball can be adjusted for the batter that is practicing. Similarly, the U.S. Pat. to Stafford, No. 4,364,563 discloses a flexible batting tee to position a ball for batting practice. Other equipment relating to batting practice equipment includes the U.S. Pat. to Hefler, No. 4,438,927, the U.S. Pat. to Able, No. 3,429,571, and the U.S. Patent to Bay, No. 4,127,267.

SUMMARY OF THE INVENTION

According to the present invention, we have discovered a batting swing training device which will improve the batter's hitting power and indicate to the batter when an inartfully executed swing has occurred, thereby to train the batter so that a properly sequenced batting swing can be achieved. As indicated above, the best batting swing includes a swing of the torso to a certain point, and then followed by a snap of the wrists. A dip in the elbow(s) or an extension of the bat will cause a premature modification of the swing of the torso, thus causing a "hacking up" on the ball. We have found that the batter can readily identify a premature modification of the torso swing when the apparatus of the present invention is used. If the batter stands in a normal stance and begins to swing, and dips the elbow or extends the bat before the bat is parallel to the path of the ball being thrown (or presented on a batting tee) the bat will strike a swing guide that is a portion of the apparatus of the present invention and is disposed in a position substantially in a vertical plane with the rear shoulder (hereinafter sometimes referred to as off the rear shoulder) the top of which is preferably at least as high as the rear shoulder. If the batter does not strike the swing guide, the wrists can be snapped and the ball can be readily hit on the batting tee, if the batter properly carries through with the swing. In the preferred embodiment of the apparatus, the height of the top of the batting tee and the height of the top of the swing guide is adjustable whereby to accommodate a wide variety of batters of different heights and different batting stances, and also for establishing what could be considered different pitches due to the location of the ball on the tee relative to the batter. Moreover, the distance between the swing guide and the batting tee is adJustable whereby to also provide for differences in batting stances and different sized players.

Preferably, the batting tee and the swing guide are disposed upon a horizontal support, the batting tee and the swing guide being disposed adjustably relative to each other on a horizontal plane. A replica of home plate is disposed on the horizontal support member so as to give the batter the illusion of standing in a batter's box and of a baseball diamond whereby to provide a reference point for the batter's position relative to the ball.

DESCRIPTION OF THE PREFERRED EMBODIMENTS

Figure 1:
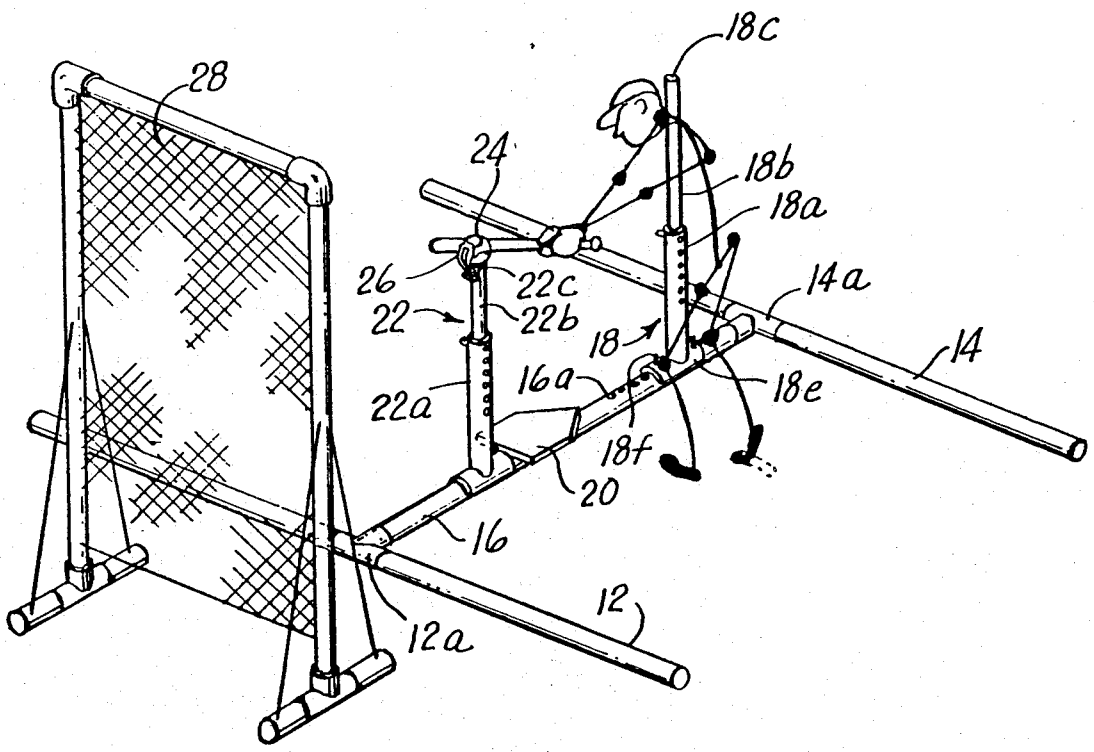
FIG. 1 is a perspective view illustrating the baseball training apparatus of the present invention.

Referring now to FIG. 1, the apparatus of the present invention includes two parallel support members 12 and 14 that extend outwardly from a central support member 16. The parallel support members are preferably attached to the central member by means of conventional plumbing tees 12*a* and 14*a*. The central support member 16 rests upon the ground and supports a simulation of a home plate 20. Home plate 20 can be attached to the central member 16 by conventional nuts and bolts, as desired, or by a snap fitting molding on the bottom surface (neither of which is shown). 10. The baseball tee 22 includes an outer telescoping member 22*a* and an inner telescoping member 22*b*. The height of the top 22*c* of the inner telescoping member is adJustable by several means such as, frictional engagement of the outer side walls of the inner telescoping member 22*b* against the inner side walls of the outer telescoping member 22*a*, or by means of removable pins inserted into holes formed in the outer telescoping member 22*a* upon which the inner telescoping member 22*b* can rest.

Figure 4:
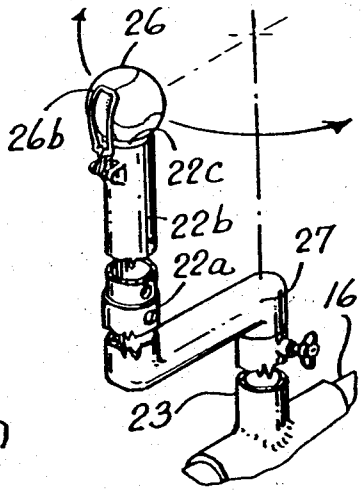
FIG. 4 is an elevational view of an alternative embodiment of a portion of a batting tee that can be used with the training apparatus of the present invention.

In the alternative embodiment shown in FIG. 4, the baseball tee 22 has been modified by including a pivotable goose-neck 27 on the end of the outer telescoping member 22*a*. Through the use of the goose-neck 27 on the telescoping member 22*a*, the batter can make provision for the simulation of inside and outside pitches, whereby the swing and stance for these pitches can be practiced also. Other than the inclusion of the goose-neck, the balance of the baseball tee can be the same as has been described with reference to FIG. 1.

The swing guide 18 includes an outer telescoping member 18*a* forming a standard and an inner telescoping member 18*b*. The top 18*c* of the batting guide can be adjustable in height in the same manner as the batting tee 22. Preferably, the top 18*c* is disposed on a plane with the batter's rear shoulder. The outer walls of the inner telescoping member 18*b* can engage the inner side walls of the outer telescoping member 18*a*, or a removable pin can be disposed in the outer telescoping member 18*a* to support the inner telescoping member 18*b*.

Both inner telescoping members 22*b* and 18*b* can be made of a flexible material which will not be easily damaged or shattered, or harm the batter, when hit. A wide variety of plastic materials may be used for the inner telescoping members 22*b* and 18*b*. Exemplary of such materials are closed cell polyethylene foams which can readily frictionally engage the inside of the outer telescoping support members 22*a* and 18*a*. Preferably, the other structural elements of apparatus are formed of a lightweight plastic material such as PVC pipe. PVC pipe can be readily assembled and disassembled, with threads in the joints 12 and 14*a*, if desired for easy assembly or with adhesives for a more permanent structure. Other portions of the apparatus such as the outer telescoping supports 22*a* and 18*a* can also be formed of the PVC plastic. The parallel support members 12 and 14 are spaced from each other by a sufficient distance to enable a batter to stand at the simulation of home plate 20 unencumbered by the piping.

The distance between the swing guide 18 and the batting tee 22 is fixedly arranged by means of collar 18*e* that rests upon central support member 16 and may frictionally engage it, or may be secured to it by means of nuts and bolts or other suitable able fasteners 18*f* disposed and holes 16*a*.

In many situations, it is desirable to have a batting net or ball catcher 28 disposed in front of the batting tee 22 so that when the ball 24 supported on the inner telescoping member 22*b* is hit, it will enter the netting and allow for a reduction in the size of the area necessary to practice. The netting can be of any conventional material such as polypropylene and the support structure can be formed of PVC pipe, the elements of which can be conventionally joined together.

Figure 2:
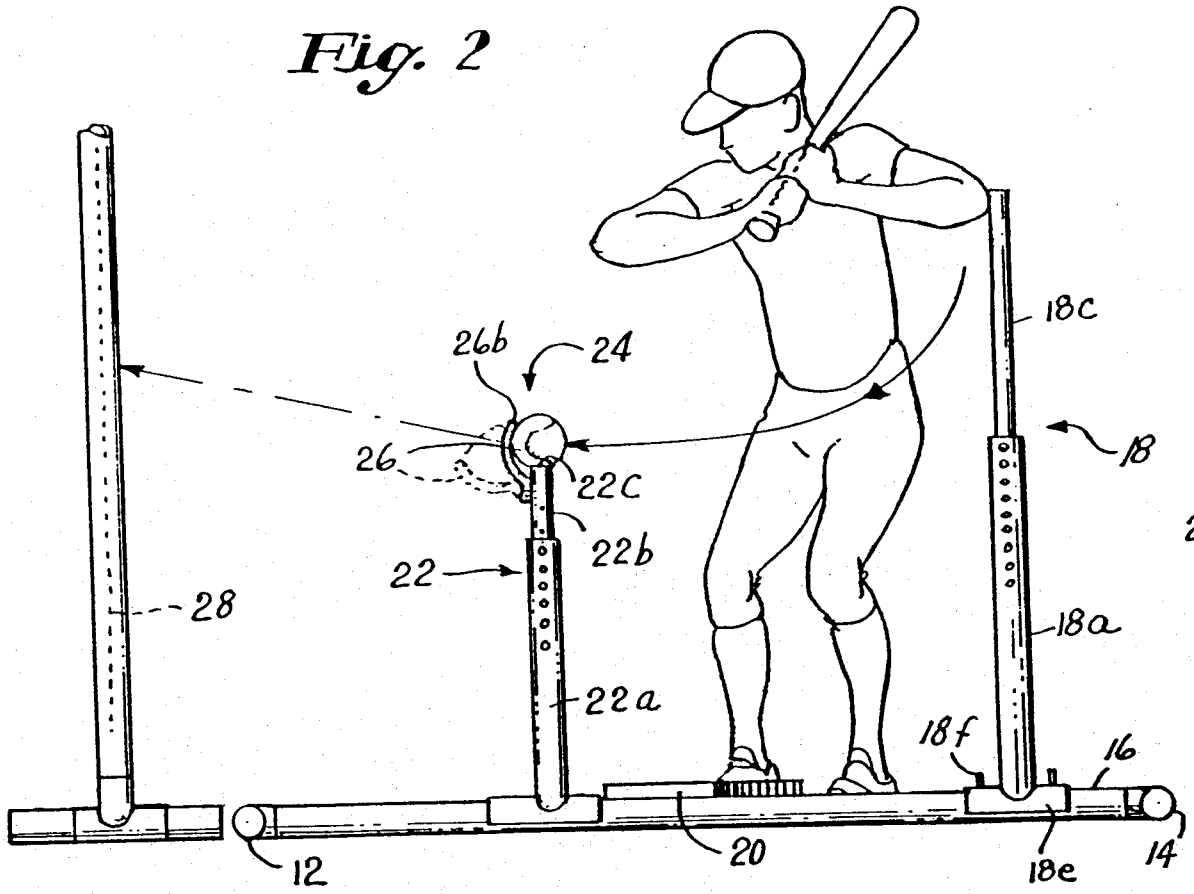
FIG. 2 is a side elevational view of the apparatus shown in FIG. 1.

As can be seen in FIG. 2, it is preferred to have the height of the top 18*c* of the swing guide 18 higher than the top of the batting tee 22 and at least as high as the batter's rear shoulder. While in some situations, a variation in the preferred relative heights may be desired, we have found that the relative positioning as shown is preferred.

The ball 24 is disposed upon the top 22*c* of the batting tee 22 and preferably is engaged by a spring loaded clamp member 26 that temporarily retains the ball 24 when the ball is hit by the batter, so as to provide a sensation of a thrown ball being impacted against the bat. The ball will disengage itself from the spring loaded clamp 26 upon proper impaction with the bat. In many situations, however, it may be desirable to only have a flat surface on the top 22*c*, or one that is slightly concave, whereby to present the ball.

Figure 3:
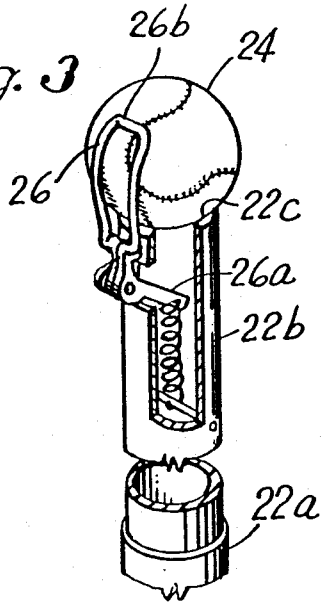
FIG. 3 is a preferred embodiment in which the baseball is held on the batting tee by a spring loaded retainer which will provide simulation of a thrown pitch when the batter hits the ball.

As best shown in FIG. 3, the clamp 26, is spring loaded and pivotable upon an axis 26*a* that is urged towards the axis of the inner telescoping support member 22*b* by means of a spring 26*a*. The ball is engaged between the distal end 26*b* of the clamp 26 and the top of the inner telescoping member 22*a*, the clamp 26 being movable and releasable holding the ball 24 within its grip.

In operation, a baseball 24 is placed on the batting tee 22. The height of the inner member 22*b* can be adJusted so that a batter may practice hitting simulations of various pitches or the goose-neck arrangement shown in FIG. 4 may be used. The swing guide 18 is positioned just off the batter's rear shoulder and the top 18*c* is disposed to a height on a plane therewith when the batter is in the proper stance in the batter's box The height of the top 18c of the swing guide 18 can be varied depending on the height and stance of the batter while the front telescoping member 22 can also be varied in height or swiveled in location to simulate various pitches. In operation, the batter takes a proper stance in the batter's the telescoping inner members 18b and 22b and ball having been previously positioned to the desired heights and locations. While the batter keeps focus on the baseball 24, an attempt is made to swing the bat in front of, i.e., inside the upper telescoping member 18b and top 18c primarily using the batter's torso until the bat just passes the upper telescoping member 18b (the bat being generally parallel to path of the ball being thrown) thereafter the swing is continued primarily using the batter's arms and wrists which extend to the V-shape and the power portion of the swing. The height of the top 18c of the swing guide 18 which is preferably at least shoulder height of the batter prevents the batter from deviating from the parallel position of the bat with respect to the path of the ball during this initial phase of the swing. If the swing is inartfully carried out, the bat will hit a portion of the swing guide 18b so as to advise the batter that the bat was swung incorrectly. Assuming that the swing guide 18 was not hit, the batter will carry out the swing by forming the V-shaped disposition of the arms and attempt to hit the ball 24. If all of the elements of a good swing are present, the ball will be hit and thrust into the netting 28.

It is apparent that modifications and changes can be made within the spirit and scope of the present invention but it is our intention, however, only to be limited by the scope of the appended claims.

What is claimed is:

1. A batting swing practice apparatus for baseball batters of different sizes and batting stances comprising:

a base plate member, a batting tee and a swing guide means, said base plate, batting tee and swing guide being positioned on and above said central support member;

an elongated central member;

said base plate member having a configuration simulating a conventional home plate disposed on said central support member and detachable therefrom; said batting tee being vertically adjustable and having its lower end attached to said central support member adjacent to and forward of said base plate member;

a baseball support means disposed on the upper end of said batting tee; and vertically extending swing guide means attached to said central support member and movable thereon relative to said base plate to a position sufficiently rearward of said base plate member to enable a batter to stand therebetween to swing a bat, but within the path of the swing of said bat whereby initial swinging contact of the bat with said swing guide means indicates an improper initial swing; and initial swinging of the bat without contact with said swing guide means indicates a proper initial swing.

2. The apparatus according to claim 1 wherein each of said batting tee and said swing guide means includes an outer telescoping member attached to said central support member and an inner telescoping member disposed in said outer telescoping member whereby the height of the top of each can be adjusted.

3. The apparatus according to claim 2 wherein each inner telescoping member is flexible.

4. The apparatus according to claim 2 wherein the batting tee has a goose-neck pivotably disposed on the outer telescoping member whereby to simulate differently thrown pitches.

5. The apparatus according to claim 1 further including clamp means on the top of said batting tee whereby to temporarily retain the baseball as it is struck by the bat.

6. A batting swing practice apparatus for baseball batters of different sizes and batting stances comprising:

a base plate means, a batting tee means and a swing guide means disposed upon a common base surface in generally linearly spaced positions;

said base plate means having a configuration simulating a conventional home plate;

said batting tee means being vertically adjustable in height and disposed forward of said base plate means;

a baseball support means disposed on the upper end of said batting tee means; and said swing guide means being vertically extendable to at least shoulder height of a batter and positioned sufficiently rearward of said base plate means and said batting tee means to enable a batter to stand therebetween to swing a bat, but within the path of the swing of said bat whereby initial swinging contact of the bat with said swing guide means indicates an improper initial swing; and initial swinging of the bat without contact with said swing guide means indicates a proper initial swing.

7. The apparatus according to claim 6 wherein each of said batting tee and said swing guide means includes an outer telescoping member attached to said central support member and an inner telescoping member disposed in said outer telescoping member whereby the height of the top of each can be adjusted.

8. The apparatus according to claim 7 wherein each inner telescoping member is flexible.

9. The apparatus according to claim 7 wherein the batting tee has a goose-neck pivotably disposed on the outer telescoping member whereby to simulate differently thrown pitches.

10. The apparatus according to claim 6 further including clamp means on the top of said batting tee whereby to temporarily retain the baseball as it is struck by the bat.

11. The apparatus according to claim 6 wherein said batting tee and said swing guide are formed of conduits and each is formed of a flexible member that telescopes inside of a support.

12. The apparatus according to claim 11 wherein the upper portion of each telescoping member is formed of a foam plastic that frictionally engages the walls of the conduit.

* * * * *

UNITED STATES PATENT AND TRADEMARK OFFICE

CERTIFICATE OF CORRECTION

PATENT NO. : 4,886,267

DATED : December 12, 1989

INVENTOR(S) : Terrence P. Licciardi, et al.

It is certified that error appears in the above-identified patent and that said Letters Patent is hereby corrected as shown below:

In claim 1, column 5, line 42, insert --support-- after "central"

Signed and Sealed this

Twelfth Day of March, 1991

*Attest:*

HARRY F. MANBECK, JR.

*Attesting Officer*

*Commissioner of Patents and Trademarks*